US006588627B2

(12) United States Patent
Petterson et al.

(10) Patent No.: US 6,588,627 B2
(45) Date of Patent: Jul. 8, 2003

(54) AUTOMATIC INTERMITTENT AEROSOL DISPENSING VALVE

(75) Inventors: Tor H. Petterson, deceased, late of Rancho Palos Verdes, CA (US), by Grace C. Petterson, executor; Thomas Jaworski, Racine, WI (US); David J. Houser, Racine, WI (US); Michael G. Knickerbocker, Crystal Lake, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/002,664

(22) Filed: Oct. 31, 2001

(65) Prior Publication Data

US 2003/0080141 A1 May 1, 2003

(51) Int. Cl.[7] ..... G01F 11/00

(52) U.S. Cl. ..... 222/1; 222/645; 222/649; 222/402.13

(58) Field of Search ..... 222/1, 644, 645, 222/649, 402.11, 402.13, 402.2

(56) References Cited

U.S. PATENT DOCUMENTS

| | | | | |
|---|---|---|---|---|
| 3,419,189 A | * | 12/1968 | Iketani | 222/54 |
| 3,477,613 A | | 11/1969 | Mangel | |
| 3,497,108 A | | 2/1970 | Mason | 222/61 |
| 3,658,209 A | | 4/1972 | Freeman et al. | |
| 4,077,542 A | | 3/1978 | Petterson | |
| 4,396,152 A | | 8/1983 | Abplanalp | |
| 5,018,963 A | | 5/1991 | Diederich | |
| 5,025,962 A | * | 6/1991 | Renfro | 222/649 |
| 5,702,036 A | | 12/1997 | Ferrara, Jr. | 222/402.13 |
| 5,791,524 A | | 8/1998 | Demarest | 222/153.06 |
| 6,216,925 B1 | | 4/2001 | Garon | 222/645 |

FOREIGN PATENT DOCUMENTS

| | | |
|---|---|---|
| EP | 826608 A1 | 3/1998 |
| JP | 10216577 | 8/1998 |
| JP | 2001048254 | 2/2001 |

* cited by examiner

*Primary Examiner*—Joseph A. Kaufman

(57) ABSTRACT

A valve assembly can automatically dispense aerosol content from an aerosol container at predetermined intervals without the use of electric power. A diaphragm at least partially defines an accumulation chamber that receives aerosol content from the can during an accumulation phase. Once the internal pressure of the accumulation chamber reaches a predetermined threshold, the diaphragm moves, carrying with it a leg so as to unseal a valve stem, and thereby initiate a spray burst. The diaphragm assumes its original position when the pressure within the accumulation chamber falls below a threshold pressure. A barrier prevents the aerosol container from resupplying the accumulation chamber at a high rate during the spray phase, preferably due to a textured interface between the barrier and a passageway in which it is housed.

12 Claims, 6 Drawing Sheets

FIG. 3
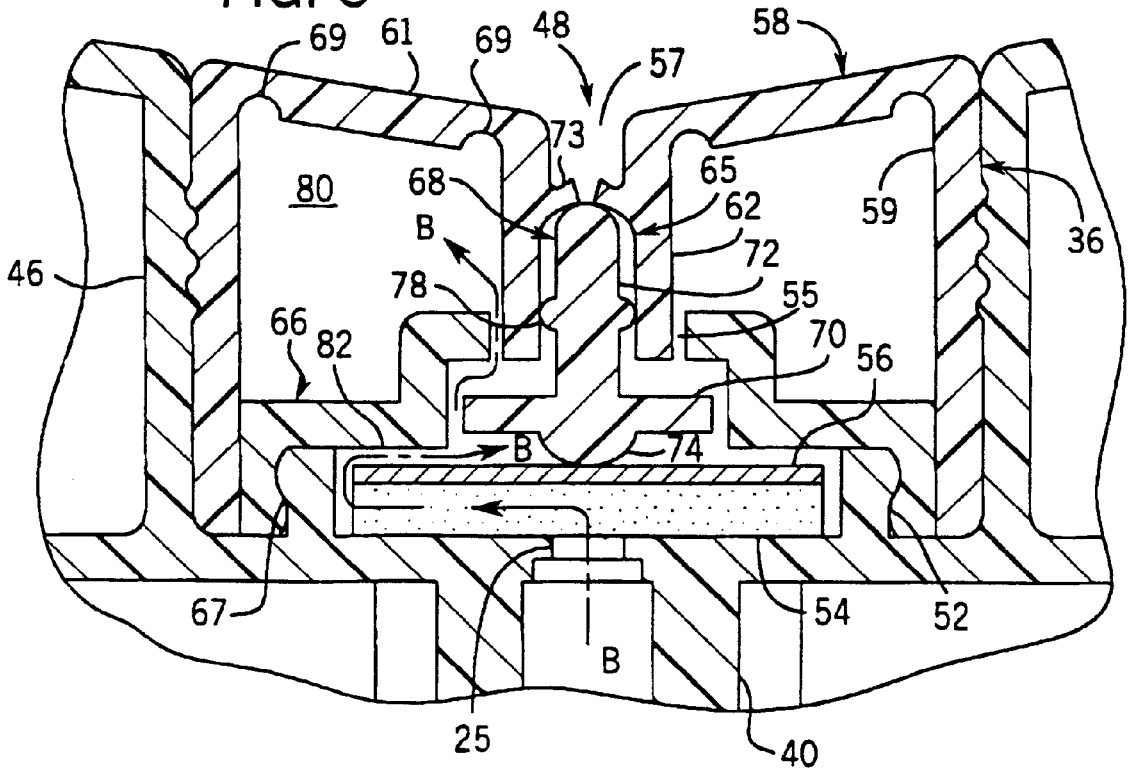
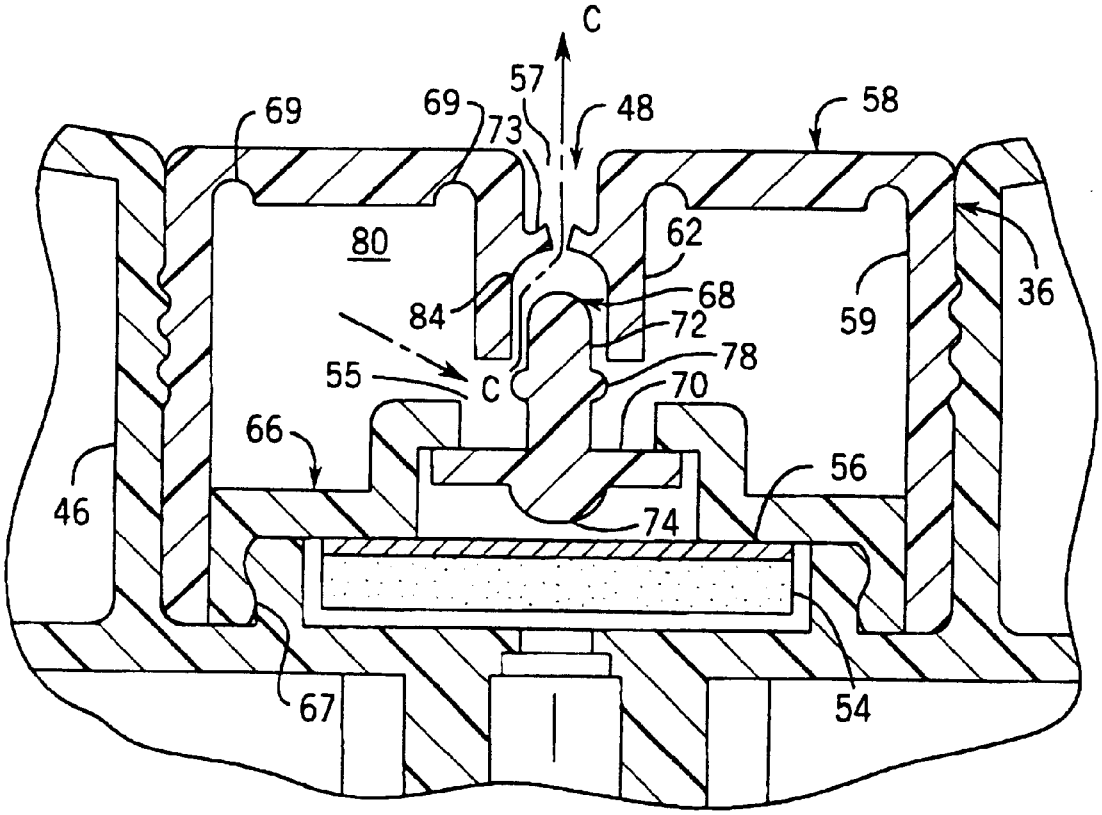
FIG. 4

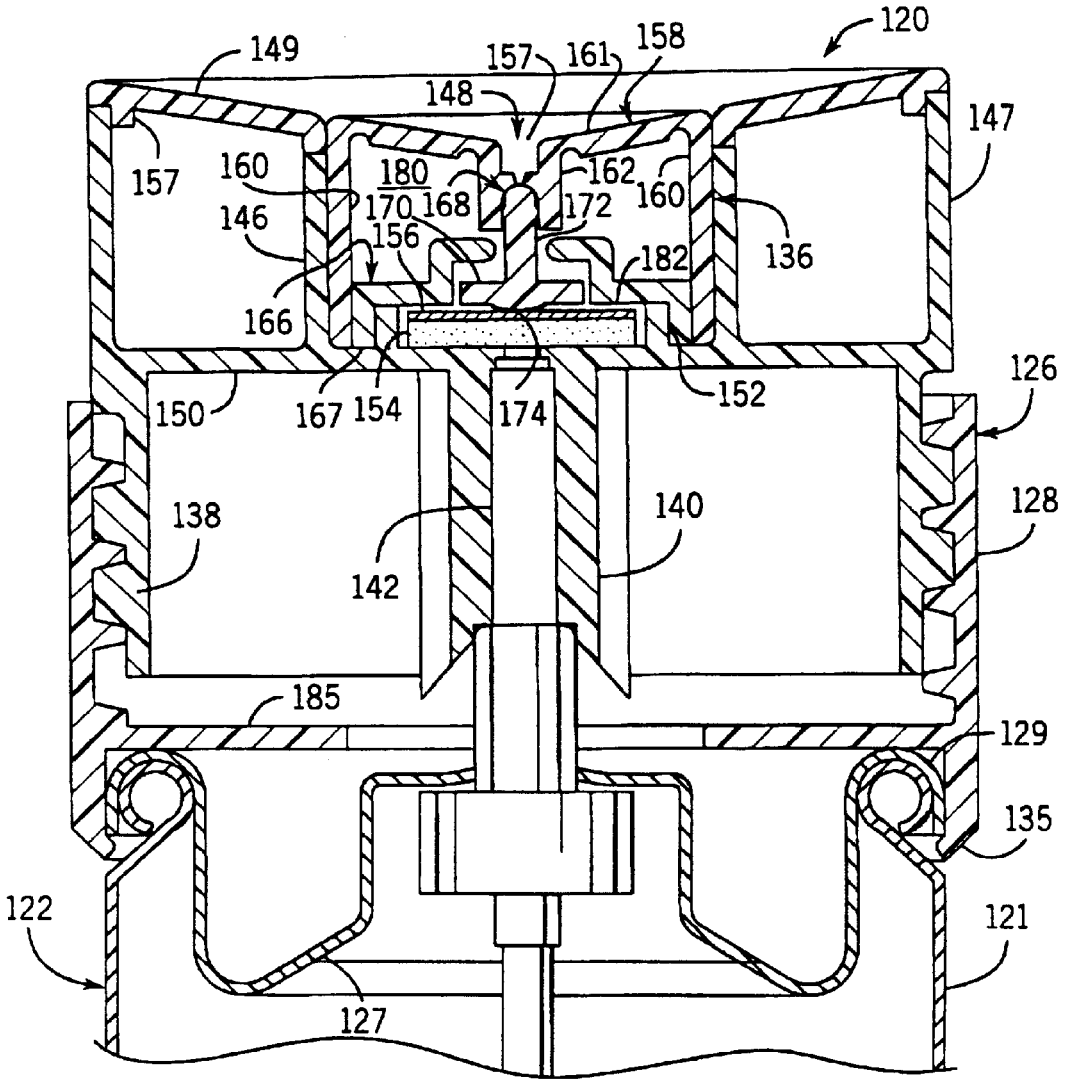
FIG. 5
FIG. 6
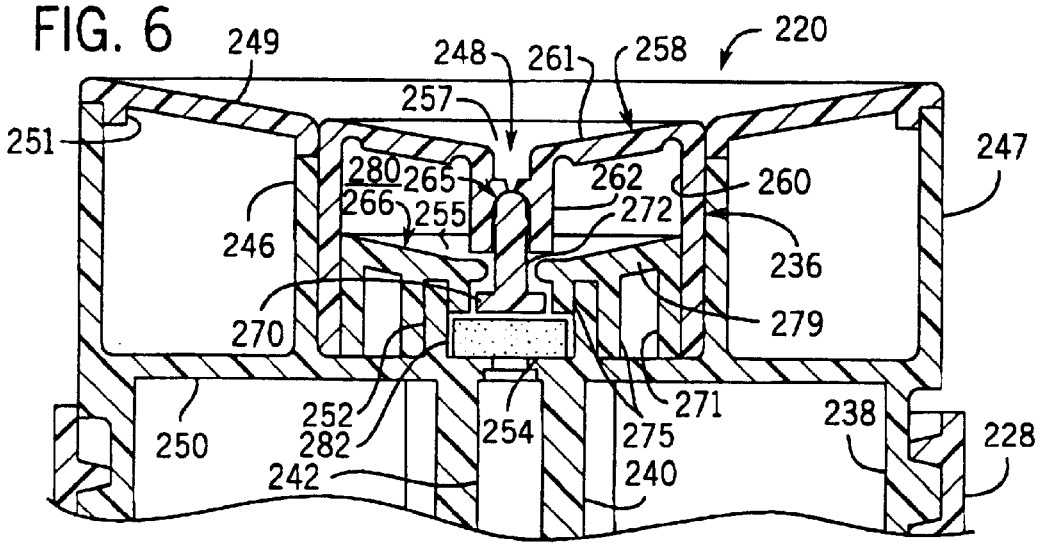

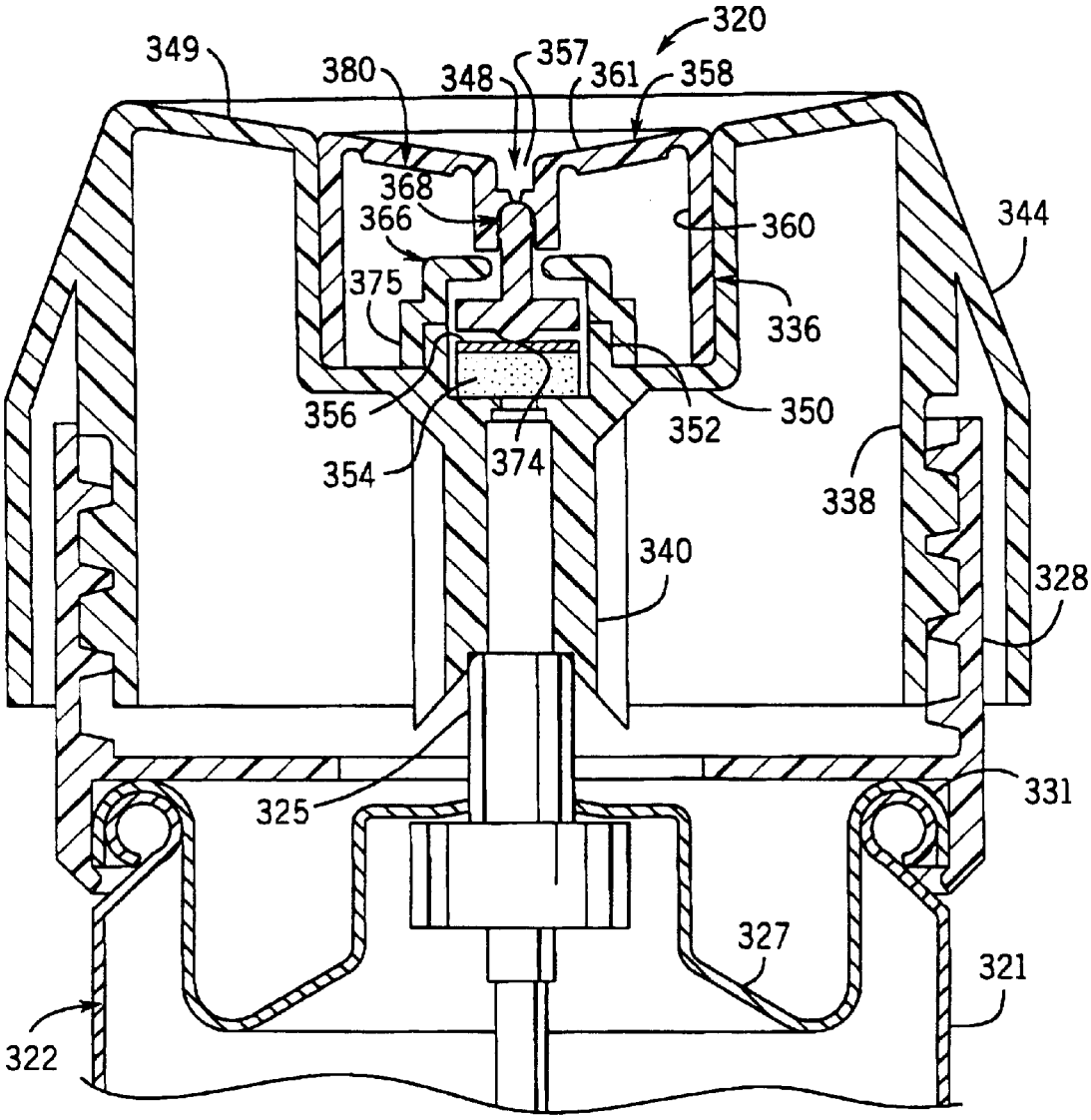
FIG. 7
FIG. 8
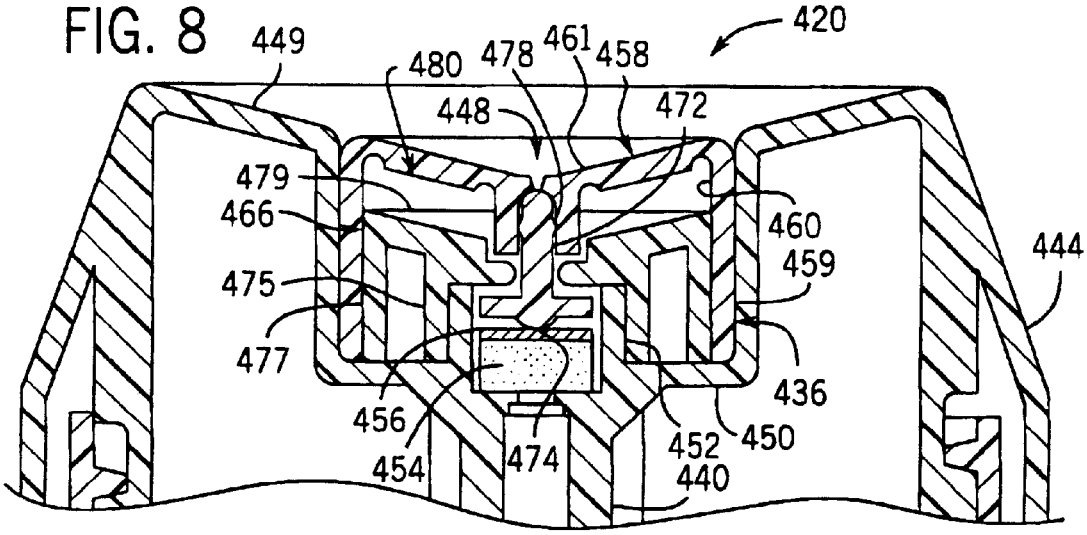

AUTOMATIC INTERMITTENT AEROSOL DISPENSING VALVE

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

The present invention relates to aerosol dispensing devices, and in particular to valve assemblies that provide automatic dispensing of aerosol content at predetermined time intervals, without requiring the use of electrical power.

Aerosol cans dispense a variety of ingredients. Typically, an active is mixed with a propellant which may be gaseous, liquid or a mixture of both (e.g. a propane/butane mix; carbon dioxide), and the mixture is stored under pressure in the aerosol can. The active mixture is then sprayed by pushing down/sideways on an activator button at the top of the can that controls a release valve. For purposes of this application, the term "chemical" is used to mean liquid, liquid/gas, and/or gas content of the container (regardless of whether in emulsion state, single homogeneous phase, or multiple phase).

The pressure on the button is typically supplied by finger pressure. However, for fragrances, deodorizers, insecticides, and certain other actives which are sprayed directly into the air, it is sometimes desirable to periodically refresh the concentration of active in the air. While this can be done manually, there are situations where this is inconvenient. For example, when an insect repellant is being sprayed to protect a room overnight (instead of using a burnable mosquito coil), the consumer will not want to wake up in the middle of the night just to manually spray more repellant.

There a number of prior art systems for automatically distributing actives into the air at intermittent times. Most of these rely in some way on electrical power to activate or control the dispensing. Where electric power is required, the cost of the dispenser can be unnecessarily increased. Moreover, for some applications power requirements are so high that battery power is impractical. Where that is the case, the device can only be used where linkage to conventional power sources is possible.

Other systems discharge active intermittently and automatically from an aerosol can, without using electrical power. For example, U.S. Pat. No. 4,077,542 relies on a biased diaphragm to control bursts of aerosol gas at periodic intervals. See also U.S. Pat. Nos. 3,477,613 and 3,658,209.

However, biased diaphragm systems have suffered from reliability problems (e.g. clogging, leakage, uneven delivery). Moreover, they sometimes do not securely attach to the aerosol can.

Moreover, the cost of some prior intermittent spray control systems makes it impractical to provide them as single use/throw away products. For some applications, consumers may prefer a throw away product.

Thus, a need still exists for improved, inexpensive automated aerosol dispensers that do not require electrical power.

BRIEF SUMMARY OF THE INVENTION

In one aspect the invention provides a valve assembly that is suitable to dispense a chemical from an aerosol container.

It is of the type that can automatically iterate between an accumulation phase where the chemical is received from the container, and a spray phase where the received chemical is automatically dispensed at intervals.

There is a housing mountable on an aerosol container, a movable diaphragm associated with the housing which is linked to a leg, the diaphragm being biased towards a first configuration, an accumulation chamber inside the housing for providing variable pressure against the diaphragm, a passageway in the housing suitable for linking an interior portion of the aerosol container with the accumulation chamber, and a valve stem positioned in the housing which the leg can ride along.

When the diaphragm is in the first configuration, the valve assembly can prevent spray of the chemical from the valve assembly. When the pressure of chemical inside the accumulation chamber exceeds a specified threshold, the diaphragm can move to a second configuration where chemical is permitted to spray from the valve assembly.

In a preferred form a barrier is provided in the passageway to regulate the flow of chemical through the passageway. There is a textured surface on at least one of the barrier and a wall of the passageway facing the barrier to provide a leak of chemical therebetween even when the barrier contacts the facing wall. This can enable some temperature compensation as the pressure of the gas increases. In this regard, when room temperature rises, the pressure of the gas in the can rises. This will press the barrier more firmly against the passageway, slightly crushing the textured surface (e.g. molded polypropylene) so that the leak flow is automatically adjusted to not increase as much with the increased temperature.

A porous material is disposed within the passageway to regulate the flow rate of chemical there through, the diaphragm is positioned on an upper wall of the housing, and the diaphragm will shift back to the first configuration from the second configuration when pressure of the chemical in the accumulation chamber falls below a threshold amount.

The valve stem and the leg are preferably both axially movable. There may also be an actuator portion of the housing that rotates to cause chemical to be able to leave the container and enter the passageway.

In an especially desirable form, the accumulation chamber has a base that is sloped (preferably radially inwardly sloped) so as to direct liquid chemical that may collect in the accumulation chamber towards the pathway.

Methods for using these valve assemblies with aerosol containers are also disclosed.

The present invention achieves a secure mounting of a valve assembly on an aerosol can, yet provides an actuator that has two modes. In one mode the valve assembly is operationally disconnected from the actuator valve of the aerosol container (a mode suitable for shipment or long-term storage). Another mode operationally links the valve assembly to the aerosol container interior, and begins the cycle of periodic and automatic dispensing of chemical therefrom. Importantly, periodic operation is achieved without requiring the use of electrical power to motivate or control the valve.

The valve assembly has few parts, and is inexpensive to manufacture and assemble. Further, it is self-cleaning to help avoid clogs and/or inconsistent bursts. One aspect of the self-cleaning operation is that the barrier can move up and down as the device cycles so that the underside of the barrier pad, and then the top of the barrier pad are flushed as the pad cycles up and down to avoid residue accumulation. Another aspect of the self-cleaning operation is the axial movement of the leg along the valve stem. Again, residue accumulation is avoided.

The foregoing and other advantages of the invention will appear from the following description. In the description reference is made to the accompanying drawings which form a part thereof, and in which there is shown by way of illustration, and not limitation, preferred embodiments of the invention. Such embodiments do not necessarily represent the full scope of the invention, and reference must therefore be made to the claims herein for interpreting the scope of the invention.

BRIEF DESCRIPTION OF THE DRAWINGS

FIG. 3 is an enlarged sectional view taken along line 3—3, during an accumulation portion of the dispensing cycle;

FIG. 4 is a view similar to FIG. 3, but with the valve in a spray configuration;

FIG. 5 is a view similar to FIG. 1, but of a second embodiment;

FIG. 6 is a view similar to FIG. 5, but of a third embodiment;

FIG. 7 is a view similar to FIG. 6, but of a fourth embodiment;

FIG. 8 is a view similar to FIG. 7, but of a fifth embodiment;

DETAILED DESCRIPTION OF THE PREFERRED EMBODIMENTS

Figure 1:
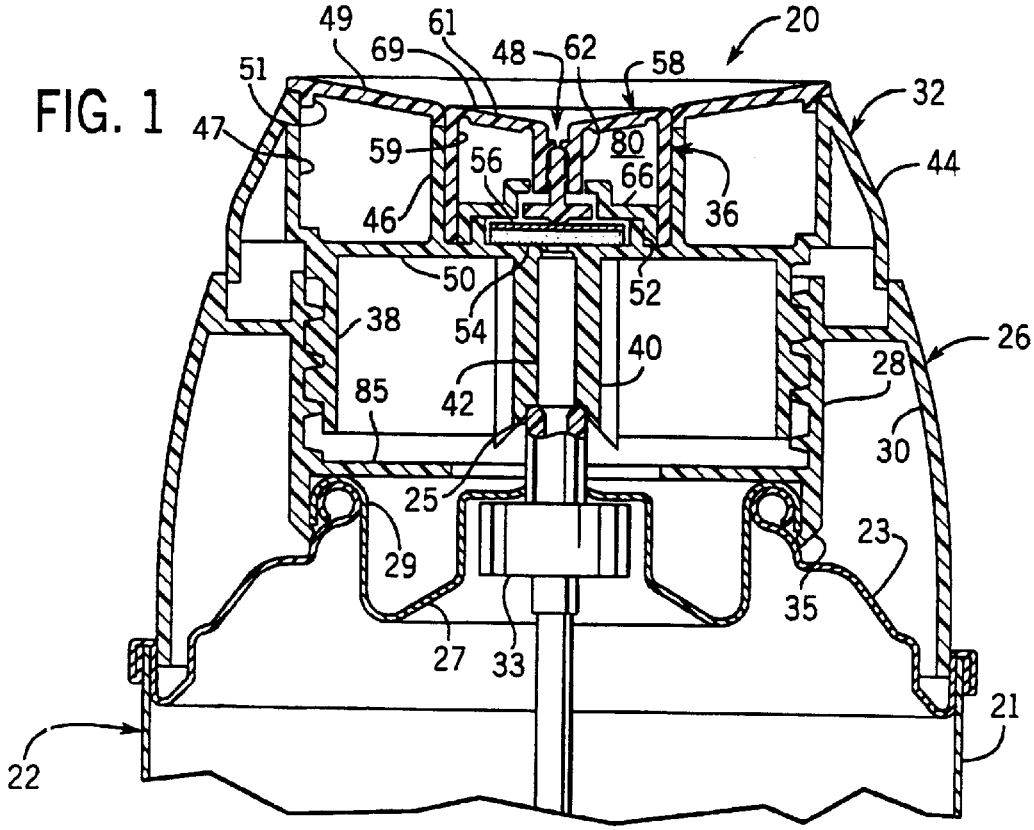
FIG. 1 is a sectional view of an automatic dispensing valve of the present invention in an "off" configuration, mounted onto an aerosol can.

Referring initially to FIG. 1, an aerosol can 22 includes a cylindrical wall 21 that is closed at its upper margin by the usual dome 23. The joint between the upper margin of the can wall 21 and the dome 23 is the can chime 31. An upwardly open cup 27 is located at the center of the dome 23 and is joined to the dome by a rim 29.

Conventional valve 33 is located at the center of the valve cup 27. The valve 33 has an upwardly extending valve stem 25, through which the contents of the can may be expelled. Valve 33 is shown as a vertically actuable valve, which can be opened by moving the valve stem 25 directly downwardly. Instead, one could use a side-tilt valve where the valve is actuated by tipping the valve stem laterally and somewhat downwardly.

Valve assembly 20 is configured for engagement with the vertically actuated type valve 33. The valve assembly 20 is mostly polypropylene, albeit other suitable materials can be used.

The valve assembly 20 has a lower portion 26 including an inner wall 28 and peripheral skirt 30 that are joined at their axially outer ends. It should be appreciated that throughout this description, the terms "axially outer, axially downstream, axially inner, axially upstream" are used with reference to the longitudinal axis of the container. The term "radial" refers to a direction outward or inward from that axis.

The inner wall 28 and skirt 30 engage the valve cup rim 29 and can chime 31, respectively. In particular, inner wall 28 has a radially inwardly extending flange 35 that is configured to snap-fit over the rim 29, while skirt 30 engages the inner surface of chime 31. In operation, the dispenser 20 can be forced downwardly onto the chime 18 and rim 29, thus fastening the dispenser 20 to the aerosol can 22.

Figure 2:
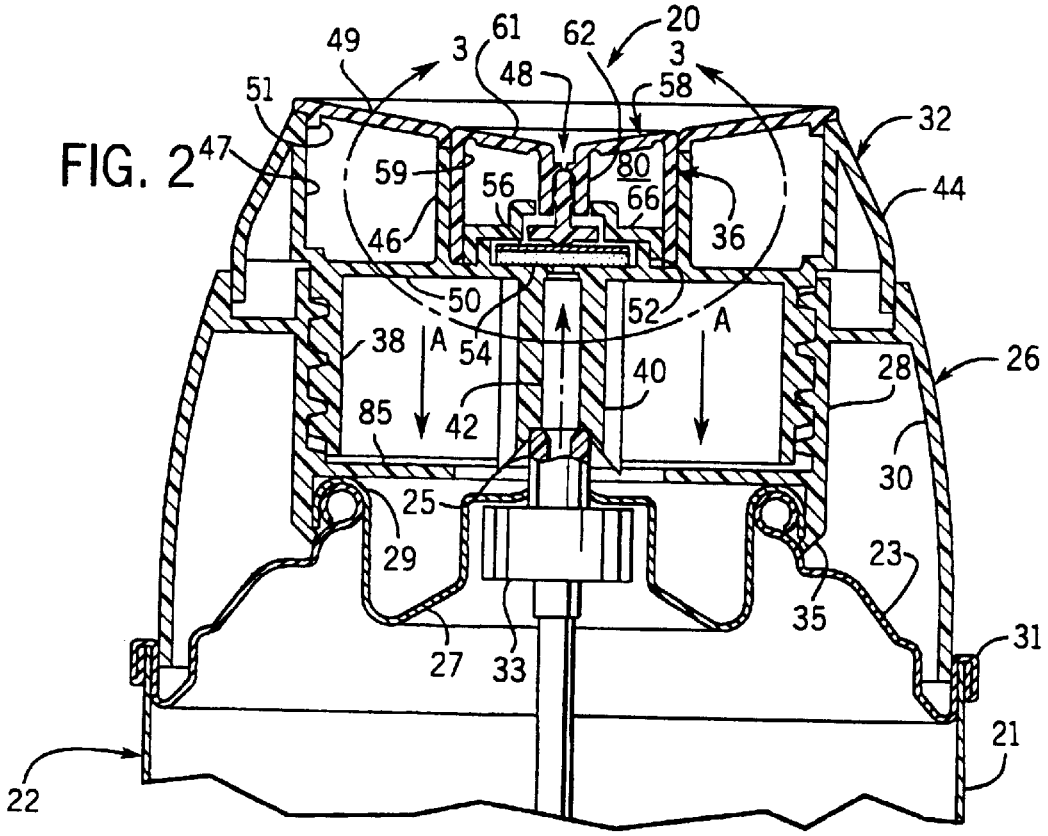
FIG. 2 is a view similar to FIG. 1, but with the valve in an "on" position.

Inner wall 28 is threaded on its radially inner surface to receive an assembly 32 that is rotatable therein. Assembly 32 includes an annular wall 38 that is threaded on its outer surface to engage the threads of inner wall 28. The threads have a predetermined pitch such that, as the assembly 32 is rotated clockwise with respect to the assembly 26, it is displaced axially along the direction of arrow A with respect to aerosol can 22, as illustrated in FIG. 2.

Assembly 32 further includes an annular wall 40 disposed radially inwardly of wall 38 that defines therein an axially extending cylindrical pathway portion 42. When assembly 26 is initially mounted onto aerosol can 22, the axially inner edge of wall 40 is located adjacent and radially aligned with the valve stem 25. However, it is not pressing down on stem 33.

Because the valve stem 33 is not yet activated in this position, the valve assembly 32 has not yet engaged the aerosol can 22, and the assembly is in a storage/shipment position. However, as the valve assembly 32 is rotated to displace the dispenser 20 along the direction of arrow A, wall 40 depresses the valve stem 25, thereby engaging the valve assembly with the aerosol can 22 and allowing the aerosol content to flow from the can into the upper valve assembly.

Assembly 32 further includes an annular wall 47 that extends axially downstream from wall 38, and is displaced slightly radially outwardly with respect thereto. An outer annular sealing wall 44 extends axially upstream and radially outwardly from the axially outermost edge of wall 47. The outer surface of axially inner portion of wall 44 engages the inner surface of a flange on skirt 30, and is rotatable with respect thereto to provide a seal between the mounting assembly 26 and valve assembly 32. Wall 44 is also easily engageable by a user to rotate the mounting assembly 26, as described above.

Walls 38 and 40 are connected at their axially outer ends by an annular, radially extending wall 50. An annular axial wall 46 extends downstream from wall 50, and defines at its axially outer edge a seat for an annular radially extending cover 49, which is further supported by wall 47. In particular, cover 49 has an axially inwardly extending flange 51 disposed proximal its radially outer edge that engages the inner surface of wall 47. Wall 46 defines an internal void 36, which is occupied by a flow regulation assembly 48, as is further illustrated in FIG. 3.

As best seen in FIGS. 3 and 4, flow regulation assembly 48 has an annular base which is defined by that portion of annular wall 50 that extends radially inwardly of wall 46. Wall 50 defines a centrally disposed cylindrical opening that is aligned with conduit 42 and enables fluid (e.g. liquid/gas) to flow from the can 22 into assembly 48.

A flexible, mono-stable diaphragm 58 is disposed within void 36, and is movable between a first closed position (FIG. 3), and a second open position (FIG. 4) to activate the valve assembly 32 at predetermined intervals, as will be described in more detail below. Diaphragm 58 includes a radially outer, axially extending wall 59 disposed radially inwardly of, and adjacent wall 46. Wall 59 is connected at its axially outer end to a cover 61. Diaphragm 58 further includes a radially inner, axially extending leg 62 that is also connected at its axially outer end to the cover 61. Cover 61 includes a centrally disposed opening that defines an outlet 57 of the dispenser 20 for emitting aerosol content, as will be described in more detail below. The cover 61 includes a pair of notches 69 disposed adjacent the axially extending walls 59 and 62 that support the iteration of the diaphragm 58 between its open and closed positions.

The diaphragm, in combination with a retainer wall 66, define an accumulation chamber 80 that accepts aerosol contents from can 22. The radially inner surface of retainer wall 66 and radially outer surface of inner wall 62 are displaced from one another to define a mouth 55 that provides an inlet and outlet for the accumulation chamber 80.

An annular flange 52 extends axially outwardly from wall 50 and is positioned radially inwardly of wall 46, and defines a seat for a gasket/barrier 54, which can be made of a porous open-celled foam or any other similarly permeable material. The axially outer surface of gasket 54 may be laminated as at 56 to slow fluid from flowing axially there through.

Figure 10:
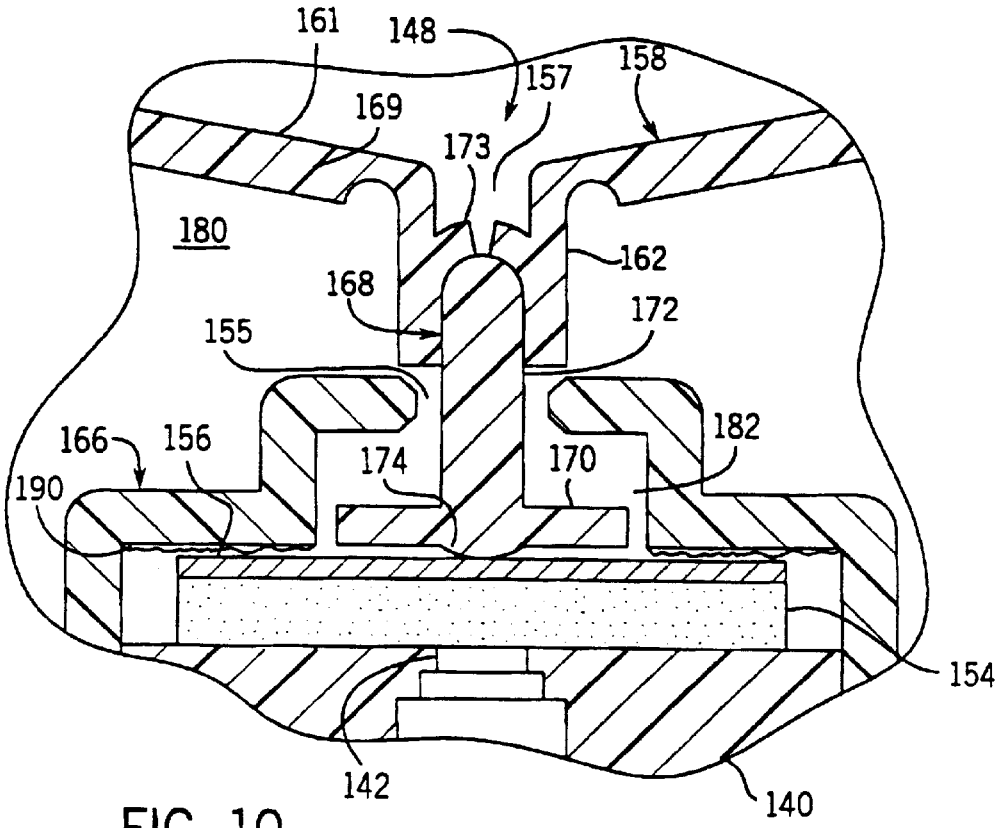
FIG. 10 is an enlarged sectional view of the valve assembly of FIG. 5, albeit showing a textured passageway surface facing the movable barrier plate.

As is exemplified in FIG. 10, it is particularly preferred for a wall (preferably a downwardly facing wall) of the passageway facing the barrier to have a textured surface. Alternatively, that surface could be smooth as shown in FIG. 3 with the facing surface of the lamination layer 56 being textured. This permits a slow leak there between even when the barrier is at its uppermost position. This provides temperature compensation.

Turning again to FIGS. 3 and 4, the retainer wall 66 extends axially outwardly and radially inwardly from the void disposed between flange 52 and wall 59, and is stepped to define a flow path for the aerosol contents. The retainer 66 is further held in place by a snap retention seal 67 that engages the radially outer surface of flange 52.

The combination of retainer wall 66 and inner wall 62 defines an "inverted T" shaped centrally disposed opening that is occupied by a valve stem 68 having a disk base 70 integrally connected to a post 72 that extends axially outwardly there from. Stem 68 further includes a knob 74 extending axially inwardly from base 70 that engages the outer surface of lamination layer 56. Gravity (and/or pressure from the diaphragm) biases the barrier 54 down, thereby carefully controling the flow rate of aerosol content into the dispenser 20 during the accumulation cycle. The more permeable the barrier, the shorter the cycle.

Stem 68 is secured within cavity 65 by an ankle 73 that extends inwardly from radially inner wall 62, and that engages the axially outer surface of post 72. The post 72 further includes an integral ring 78 extending radially outwardly there from that engages the inner surface of leg 62 to provide a seal that prevents aerosol content stored in the accumulation chamber 80 from escaping out the outlet 57 of dispenser 20 during the accumulation phase.

The outer diameter of gasket 54 is slightly less than the inner diameter of annular flange 52. Accordingly, aerosol content flowing from conduit 42 is directed radially outwardly around gasket 54 and into an intake channel 82. Channel 82 then extends radially inwardly, as the axially outer surface of layer 56 is slightly displaced from the axially inner surface of wall 66. Base 70 is displaced from retainer wall 66, and the outer diameter of leg 62 is less than the inner diameter of axial outermost portion of wall 66. Accordingly, intake channel 82 (including gasket 54 and conduit 42) extends from valve stem 25 to the mouth 55 of the accumulation chamber 80.

In operation, a consumer rotates the valve assembly 32 relative to mounting assembly 26, preferably by rotating wall 44. This causes the valve assembly 32 to become displaced axially inwardly, and biases wall 40 against valve stem 25, thereby causing the aerosol contents to flow out of can 22, and beginning the accumulation cycle. The aerosol contents flow through conduit 42 and into the axially inner surface of gasket 54, exit through the radially outer surfaces of gasket, and travel along the direction of arrow B through channel 82 into the mouth 55 of accumulation chamber 80. The porosity of the gasket 54 regulates the rate at which the aerosol contents are able to flow through channel 82.

During the accumulation phase, the constant supply of aerosol content flowing from intake channel 82 into the accumulation chamber 80 via mouth 55 causes pressure to build therein, and such pressure acts against the underside of diaphragm 58. Once the accumulation chamber 80 is sufficiently charged with aerosol content, such that the pressure reaches a predetermined threshold, the mono-stable diaphragm 58 becomes deformed from the normal closed position illustrated in FIG. 3 to the open position illustrated in FIG. 4. This initiates a spray phase as feature 78 no longer abuts against leg 62.

In particular, once the diaphragm 58 is open, leg 62 and ankle 73 are moved downstream of seal ring 78 and post 72, respectively, to create an outlet channel 84 extending between mouth 55 and the outlet end 57 of the dispenser 20. Accordingly, during the spray phase, the stored aerosol content flows from mouth 55, along outtake channel 84 along the direction of arrow C, and out the outlet end of dispenser 20 into the ambient environment. It should be appreciated that the axial movement of leg 62 away from retainer 66 widens mouth 55, thereby enabling a greater flow rate out of the accumulation chamber 80 during the spray cycle than the flow rate into the accumulation chamber during the accumulation phase.

The stored aerosol content exits the dispenser 20 as a "puff". The flow rate of the aerosol content that is expelled during the spray phase may further be controlled by adjusting the clearance between leg 62 and post 72. Also during the spray cycle, the stem 68 and gasket 54 become displaced axially outwardly under pressure from aerosol content exiting valve stem 25. Accordingly, layer 56 moves against retainer wall 66, thereby providing a barrier that greatly restricts channel 82 and prevents aerosol contents from flowing too rapidly from the can during this phase.

During the spray phase, the pressure within the accumulation chamber immediately abates as the stored aerosol content exits the dispenser 20. Once the pressure falls below a predetermined threshold, the diaphragm snaps back to its normal position, re-establishing the seal between element 78 and leg 62. As the diaphragm 58 closes, flange 73 biases the stem 68 axially inwardly which causes knob 74 to bias the gasket axially inwardly, thereby removing the partial seal to channel 82 that was formed between retainer wall 66 and layer 56 during the spray cycle. Channel 82 is thus once again fully opened, and aerosol content flows into accumulation chamber 80 to initiate the accumulation phase. The cycle is automatic and continuously periodic until the can contents are exhausted.

Importantly, as the diaphragm 58 snaps back, the ankle 73 momentarily deflects the barrier 54, causing a cleansing burst of aerosol by the gap between layer 56 and the passageway wall above it. This "flushing" is particularly important in a construction such as that of FIG. 10 where that junction has a textured surface on at least one of the walls.

Referring now to FIG. 5, a dispenser is mounted onto an aerosol can 122 in accordance with an alternate embodiment of the invention. FIG. 5 is illustrated having reference numerals corresponding to like elements of the previous embodiment incremented by 100 for the sake of convenience. Dispenser 120 is configured to be mounted onto an aerosol can 122 that terminates at its radial end with a valve cup rim 129 rather than a chime as illustrated in FIGS. 1 and 2.

Accordingly, the mounting assembly includes a threaded wall 128 including radially inwardly extending flange 135 that engages valve cup rim to securely mount the dispenser 120 onto the can 122. Threaded wall 128 receives correspondingly threaded wall 138 such that a user rotates wall 147 to displace valve assembly 132 in the axial direction and actuate the dispenser 120, as described above.

As further illustrated in FIG. 10, the post 172 of stem 168 does not need to include a bulbous seal ring, but rather may fit snugly between leg portions to prevent the leakage of aerosol contents out the dispenser 120 during the accumulation phase.

Referring next to FIG. 6, a third embodiment of the invention is illustrated having reference numerals corresponding to like elements of the previous embodiment incremented by 100 for convenience. When pressurizing the accumulation chamber 80 illustrated in FIG. 1, some gaseous materials may liquefy and accumulate at the bottom of the accumulation chamber. This may result in them not being fully expelled during a single spray phase. The pooling of aerosol content could increasingly reduce the effective volume of accumulation chamber 80.

To address this problem, retainer 266 includes a radially extending wall 279 that defines the base of accumulation chamber 280. A wall 271 extends axially upstream from the radially outer end of base 279 that engages the inner surface of wall 260. A pair of radially inner walls 275 also extend axially upstream from base 279, and are spaced apart so as to receive flange 262 therein, and thereby securing retainer 266 in the dispenser 120.

Dispenser 220 includes an anti-pooling feature which prevents the accumulation of liquid within the accumulation chamber 280. In particular, base 279 of the accumulation chamber 280 slopes radially inwardly, such that unmixed liquid is forced towards the mouth 255 and in the path of aerosol content as it flows from the accumulation chamber 280 out the dispenser 220 during the spray phase. As a result, the liquid that has pooled during a single accumulation phase becomes mixed with the leaving propellant to produce a fine mist that is emitted out the dispenser 220 during the spray phase.

Base 270 of stem 268 does not include a knob on its axially inner surface, but rather is flat. Accordingly, gasket 254 need not be laminated with a protective surface, as the pressure from base 270 is equally distributed along the axially outer surface of the gasket. During the spray phase, pressure from the aerosol content exiting the valve stem biases gasket 254 against the axially inner surface of wall 275. Pressure from the aerosol content flowing through the gasket 254 biases the piston 268 axially downstream such that the base 170 rests against retainer 266, thereby sealing channel 282.

Referring now to FIG. 7, this alternate embodiment of the invention is illustrated having reference numerals corresponding to like elements of the previous embodiment, albeit incremented by 100. A dispenser 320 is illustrated as being mounted onto an aerosol can 320, but not yet activated. This embodiment presents a retainer wall 366 having a radially outer, axially extending wall 375 whose inner radius is slightly greater than the outer radius of flange 352 so as to fit snugly thereon to secure the retaining wall 366 in place.

The base of accumulation chamber 380 is thus further defined by that portion of wall 350 disposed between walls 360 and 375. A void exists between wall 375 and 360, thereby enlarging the accumulation chamber 380. Accumulation chambers having greater volume will receive a greater amount of aerosol contents before reaching the maximum threshold pressure of the diaphragm 358. Accordingly, the diaphragm will toggle between its open and closed positions at a lower frequency, and the dispenser 320 will emit a greater amount of aerosol content during each spray cycle.

Referring next to FIG. 8, yet another alternate embodiment of the invention is illustrated having reference numerals corresponding to like element of the previous embodiment incremented by 100. Retainer wall 466 is positioned within flow regulation assembly 448 via wall 475 that fits over flange 452 as described above, as well as a second axially extending wall 477 that is displaced radially outwardly with respect to wall 475. Wall 477 has an outer diameter slightly less than the inner diameter of wall to fit snugly there within. Retainer wall 466 includes a substantially radial wall 479 that is supported by walls 475 and 477, and that defines a base for accumulation chamber 480. Because wall 479 slopes radially inwardly, the flow regulation assembly 448 prevents pooling, as described above.

Figure 9:
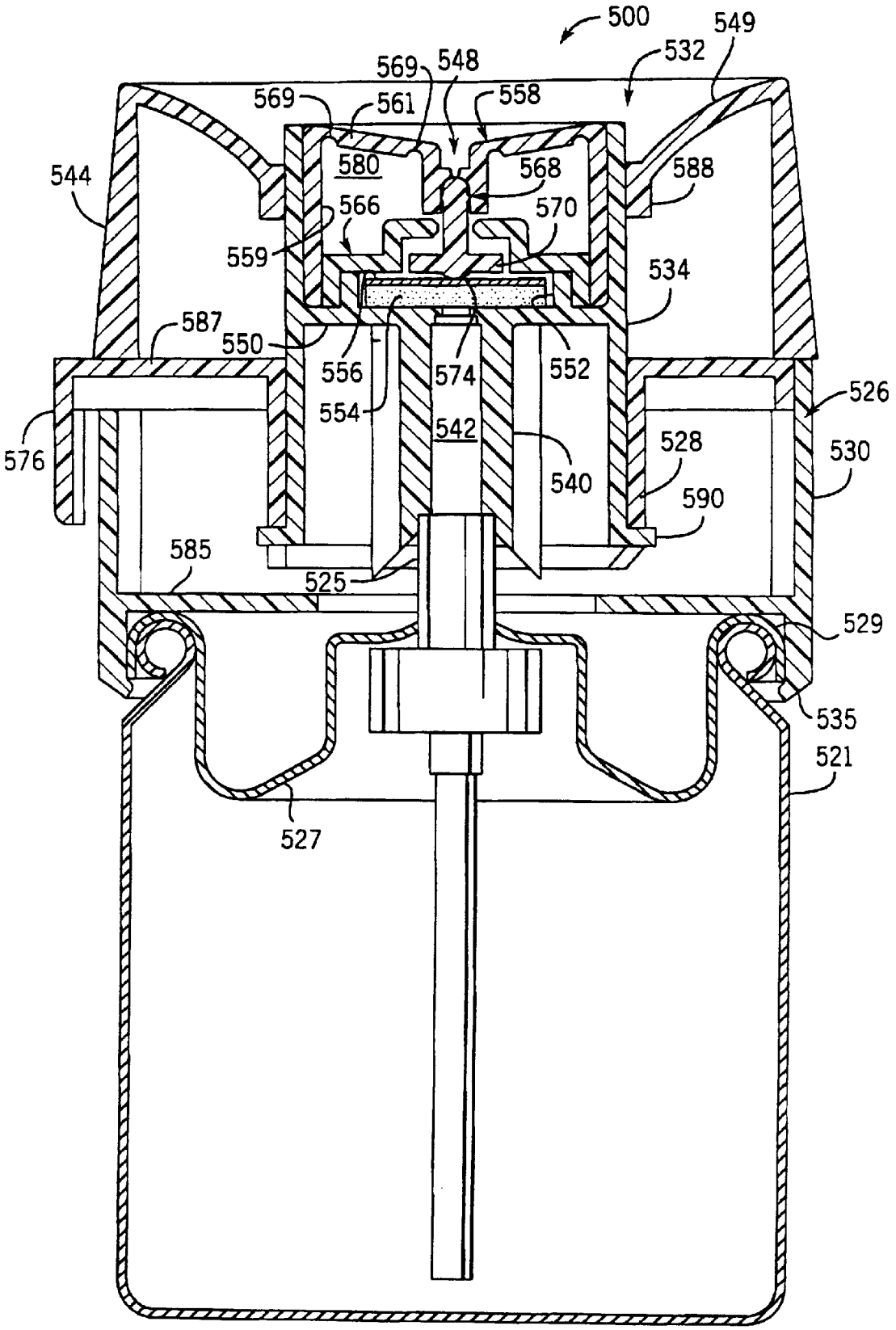
FIG. 9 is a view similar to FIG. 8, but of a sixth embodiment.

Referring now to FIG. 9, still another alternate embodiment of the invention is illustrated having reference numerals corresponding to like elements of the previous embodiment, albeit incremented by 100. Mounting assembly 526 includes a lever 576 that is rotated by a user to displace the valve assembly 532 in the axial direction, as described above. Additionally, lever 576 could include a perforated tab (not shown) between itself and wall 530 that is broken before the dispenser can be actuated, thereby providing means for indicating whether the dispenser has been tampered with.

Figure 11:
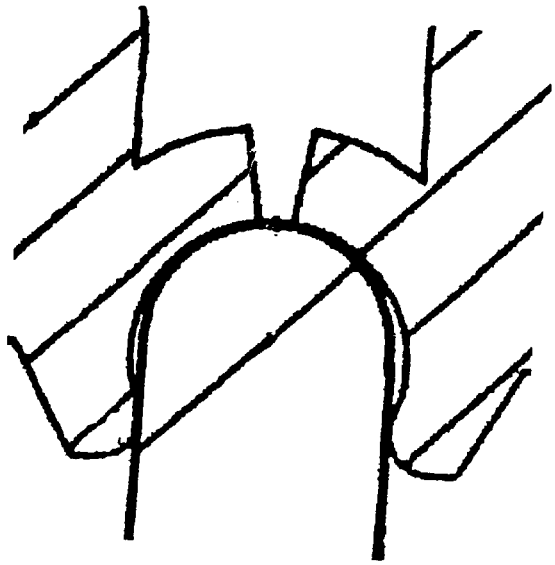
FIG. 11 is a further enlarged sectional view similar to an upper portion of the FIG. 10, but of the most preferred embodiment.

FIG. 11 depicts the most preferred way in which the diaphragm legs can seal along the valve stem. In this form, the legs do not touch the stem throughout their facing surfaces. Instead, they touch only at the top and again at the lower most facing surfaces. The primary seal is at the bottom most contact point. The secondary seal is where the rounded top of the stem presses against the underside of the nozzle area. This structure can simplify the manufacturing processes.

The above description has been that of preferred embodiments of the present invention. It will occur to those that practice the art, however, that many modifications may be made without departing from the spirit and scope of the invention. In order to advise the public of the various embodiments that may fall within the scope of the invention, the following claims are made.

INDUSTRIAL APPLICABILITY

The present invention provides automated dispenser assemblies for dispensing aerosol can contents without the use of electric power or manual activation.

We claim:

1. A valve assembly that is suitable to dispense a chemical from an aerosol container when the valve assembly is connected to such an aerosol container, the valve assembly being of the type that can automatically iterate between an accumulation phase where the chemical is received from such a container when the valve assembly is connected such an aerosol container, and a spray phase where the received chemical is automatically dispensed at intervals, the valve assembly comprising:

a housing mountable on such an aerosol container when the valve assembly is connected to such an aerosol container;

a movable diaphragm associated with the housing which is linked to a leg, the diaphragm being biased towards a first configuration;

an accumulation chamber inside the housing for providing variable pressure against the diaphragm;

a passageway in the housing suitable for linking an interior portion of the aerosol container with the accumulation chamber when the valve assembly is connected to such an aerosol container; and a valve stem positioned in the housing which the leg can ride along;

whereby when the diaphragm is in the first configuration the valve assembly can prevent spray of the chemical out of the valve assembly; and whereby when the pressure of chemical inside the accumulation chamber exceeds a specified threshold the diaphragm can move to a second configuration where chemical is permitted to spray from the valve assembly.

2. The valve assembly as recited in claim 1, wherein a barrier is provided in the passageway to regulate the flow of chemical through the passageway, and there is a textured surface on at least one of the barrier and a wall of the passageway facing the barrier to provide a leak of chemical therebetween even when the barrier contacts the facing wall.

3. The valve assembly as recited in claim 1, wherein a porous material is disposed within the passageway to regulate the flow rate of chemical there through.

4. The valve assembly as recited in claim 1, wherein the diaphragm is positioned on an upper wall of the housing.

5. The valve assembly as recited in claim 1, wherein the diaphragm will shift back to the first configuration from the second configuration when pressure of the chemical in the accumulation chamber falls below a threshold amount.

6. The valve assembly as recited in claim 1, wherein the valve stem is axially movable.

7. The valve assembly as recited in claim 1, wherein the leg has an arched surface which faces the valve stem such that opposite ends of the arched surface can contact the stem, but a portion of the arched surface therebetween does not contact the stem.

8. The valve assembly as recited in claim 1, further comprising an axially movable barrier operable to restrict flow between the interior of such a container, when the valve assembly is connected to such an aerosol container, and the accumulation chamber when the valve assembly permits external spraying of chemical, wherein the movement of the barrier assists in cleaning a portion of the valve assembly.

9. The valve assembly as recited in claim 1, wherein the leg is displaceable in an axial direction.

10. The valve assembly as recited in claim 1, further comprising such a container that is linked to the valve assembly, and an actuator portion of the housing that rotates to allow chemical to be able to leave the container and enter the passageway.

11. The valve assembly as recited in claim 1, wherein the accumulation chamber has a base that is sloped so as to direct liquid chemical that will collect in the accumulation chamber towards the pathway.

12. A method of automatically delivering a chemical from an aerosol container to an ambient environment at predetermined intervals, the method comprising the steps of:

(a) providing a valve assembly suitable for use to dispense a chemical from the aerosol container, the valve assembly being of the type that can automatically iterate without the use of electrical power between an accumulation phase where the chemical is received from the container, and a spray phase where the received chemical is automatically dispensed at intervals, the valve assembly comprising:

(i) a housing mountable on the aerosol container;

(ii) a movable diaphragm associated with the housing which is linked to a leg, the diaphragm being biased towards a first configuration;

(iii) an accumulation chamber inside the housing for providing variable pressure against the diaphragm;

(iv) a passageway in the housing suitable for linking an interior portion of the aerosol container with the accumulation chamber; and (v) a valve stem positioned in the housing which the leg can ride along; whereby when the diaphragm is in the first configuration the valve assembly can prevent the spray of the chemical from the valve assembly; and whereby when the pressure of chemical inside the accumulation chamber exceeds a specified threshold, the diaphragm can move from the first configuration to a second configuration where chemical is permitted to spray from the valve assembly;

(b) mounting the valve assembly to the aerosol container; and (c) actuating the valve assembly.

* * * * *